US007946390B2

(12) United States Patent
McNamara et al.

(10) Patent No.: US 7,946,390 B2
(45) Date of Patent: May 24, 2011

(54) TIE-DOWN COMPENSATION FOR AN ELEVATOR SYSTEM

(75) Inventors: Brian T. McNamara, Bloomington, IN (US); Alfred R. Feitl, Bloomington, IN (US)

(73) Assignee: Otis Elevator Company, Farmington, CT (US)

( * ) Notice: Subject to any disclaimer, the term of this patent is extended or adjusted under 35 U.S.C. 154(b) by 1240 days.

(21) Appl. No.: 10/556,801

(22) PCT Filed: May 30, 2003

(86) PCT No.: PCT/US03/17093

§ 371 (c)(1),
(2), (4) Date: Nov. 14, 2005

(87) PCT Pub. No.: WO2004/108576

PCT Pub. Date: Dec. 16, 2004

(65) Prior Publication Data

US 2006/0249337 A1 Nov. 9, 2006

(51) Int. Cl.
*B66B 11/08* (2006.01)
*B66B 7/08* (2006.01)
*B66B 7/10* (2006.01)

(52) U.S. Cl. ..... 187/264; 187/404; 187/411; 187/412

(58) Field of Classification Search ..... 187/264, 187/265, 266, 411, 412, 414, 404; *B66B 7/10, B66B 7/08, 11/08*

See application file for complete search history.

(56) References Cited

U.S. PATENT DOCUMENTS

| | | | | |
|---|---|---|---|---|
| 657,380 | A * | 9/1900 | Baldwin | 187/265 |
| 1,011,423 | A * | 12/1911 | Gale | 187/256 |
| 4,664,229 | A | 5/1987 | Obst | |
| 4,724,929 | A * | 2/1988 | Coleman et al. | 187/411 |
| 5,255,759 | A | 10/1993 | Kasai et al. | |
| 5,398,781 | A * | 3/1995 | Biewald et al. | 187/264 |
| 5,513,724 | A | 5/1996 | De Jong | |
| 5,750,945 | A * | 5/1998 | Fuller et al. | 187/292 |
| 6,123,176 | A * | 9/2000 | O'Donnell et al. | 187/393 |
| 6,364,063 | B1 * | 4/2002 | Aulanko et al. | 187/266 |
| 6,401,871 | B2 * | 6/2002 | Baranda et al. | 187/254 |
| 6,499,566 | B2 | 12/2002 | Ach | |
| 6,966,408 | B2 * | 11/2005 | Sweet | 187/264 |
| 2001/0025743 | A1 * | 10/2001 | Ach | 187/264 |

FOREIGN PATENT DOCUMENTS

| | | | |
|---|---|---|---|
| GB | 2270292 | A * | 3/1994 |
| WO | WO 02/34659 | A1 | 5/2002 |

OTHER PUBLICATIONS

PCT International Search Report mailed Sep. 23, 2003 relating to International Application No. PCT/US03/17093.

* cited by examiner

*Primary Examiner* — Saul Rodriquez
*Assistant Examiner* — Stefan Kruer
(74) *Attorney, Agent, or Firm* — Carlson, Gaskey & Olds PC

(57) ABSTRACT

An elevator system (20) includes a tie-down compensation arrangement (40). A tension member (42) extends between a cab (22) and counterweight (26) to provide a desired amount of tension on a load bearing rope or belt (30) that supports the cab and the counterweight. The tension member (42) in one example comprises a coated steel belt. At least one sheave (46) is supported on a base module (48) and remains stationary relative to a floor of a pit (52). A damper (50) is supported for movement with the counterweight (26) or the cab (22) to absorb energy that would otherwise tend to cause counterweight jump following a rapid descent and stop of the cab (22).

22 Claims, 5 Drawing Sheets

TIE-DOWN COMPENSATION FOR AN ELEVATOR SYSTEM

FIELD OF THE INVENTION

This invention generally relates to elevator systems. More particularly, this invention relates to a unique arrangement for maintaining traction and control within an elevator system.

DESCRIPTION OF THE RELATED ART

There are a variety of modern elevator systems. One common arrangement includes a cab and a counterweight suspended by a rope or belt. A machine causes the rope or belt to move along at least one sheave to cause a desired movement of the cab between landings within a hoistway, for example. In a typical arrangement, as the cab moves up, the counterweight moves down and vise versa.

The weight associated with the counterweight and cab typically cause tension on the rope or belt sufficient to maintain traction between the belt and the sheave that causes the desired elevator cab movement. There are situations, however, where tie-down compensation is desirable to maintain adequate rope traction. Lightweight cars and counterweights, while having other advantages, are more susceptible to the effects of shifting rope weight as the car moves through the hoistway, which can reduce traction.

Tie-down compensation arrangements limit potential "counterweight jump," which may otherwise occur as the cab moves rapidly downward and then stops. Under such circumstances the inertia associated with the upward movement of the counterweight can cause the counterweight to continue moving upward even though the cab has stopped moving downward. Such upward movement of the counterweight introduces slack into the rope until the counterweight subsequently falls to the point where the rope is again under tension. Such counterweight jump is undesirable for obvious reasons.

Typical compensation arrangements include chains, free rope and the systems having a large, moveable mass in the hoistway pit, each of which can provide tension for certain elevator system designs. While such arrangements have been useful, they are not without shortcomings and drawbacks. The significant drawback associated with conventional tie-down compensation arrangements is that they require a relatively large pit depth at the bottom of a hoistway. Modern building practices and associated economies favor shallower pit depth. In some instances, the depth required to use a conventional tie-down compensation arrangement exceeds that which is available. In some circumstances, the option of not using tie-down compensation is chosen if it is not required by a corresponding code, for example. Without such compensation, however, there is an increased likelihood that counterweight jump will occur.

Higher rise buildings further complicate the situation. For example, buildings that have a rise above 400 feet typically are not compatible with a chain compensation arrangement. However, the available pit depth often does not accommodate a free rope or moveable mass-based compensation arrangement. Using chain or free-rope compensation arrangements in such buildings can leave open the possibility for counterweight jump.

There is a need for an improved tensioning assembly that ensures appropriate traction for moving the elevator cab and minimizes or avoids counterweight jump. This invention addresses that need while avoiding the shortcomings and drawbacks of previous systems. The inventive arrangement is capable of fitting within a much smaller pit compared to the pit depth required for the previous approaches.

SUMMARY OF THE INVENTION

In general terms, this invention is an assembly that maintains appropriate tension on a load bearing rope or belt within an elevator system and minimizes the possibility for counterweight jump.

One example system designed according to this invention includes an elevator cab and a counterweight. A load bearing member is associated with the cab and counterweight. A tension member extends between the cab and the counterweight. A base module has at least one sheave that rotates about an axis that remains fixed beneath the lowest position of the cab. The tension member at least partially wraps around the sheave.

Another example system includes a damper supported for movement with the cab or the counterweight. The damper absorbs energy that otherwise would cause counterweight jump.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
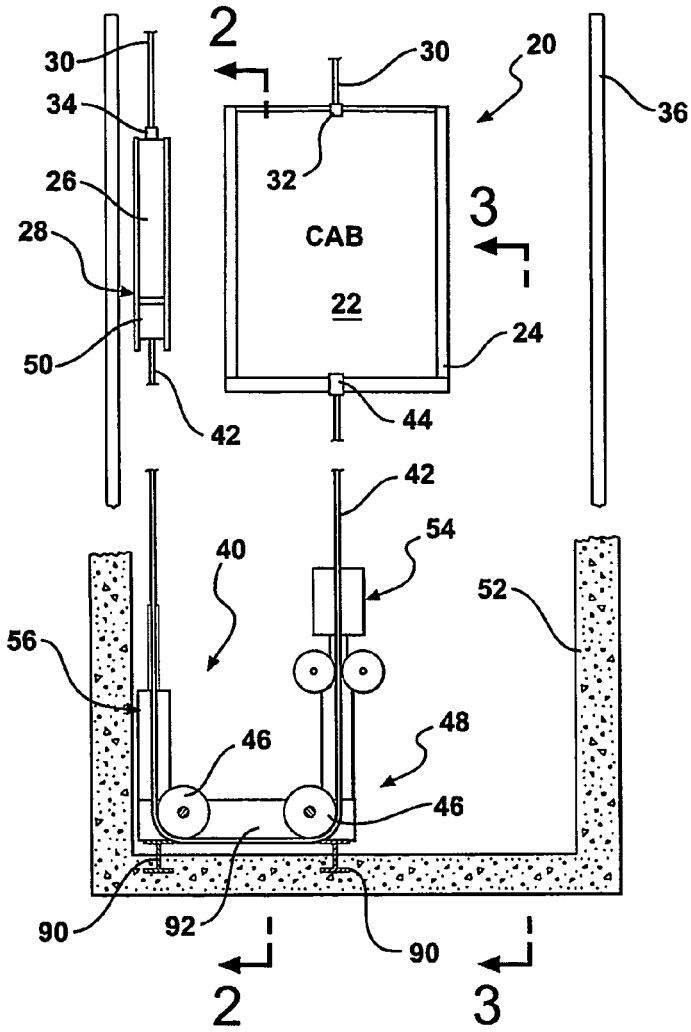
FIG. 1 schematically illustrates selected portions of an elevator system including a tie-down compensation arrangement designed according to an embodiment of this invention.

FIG. 1 schematically shows an elevator system 20 including a cab 22 that is supported by a frame 24 in a conventional manner. A counterweight 26 has an associated frame 28. A load bearing member 30, such as a rope or belt, supports the weight of the cab 22 and the counterweight 26 in a conventional manner. A conventional hitch arrangement 32 secures an appropriate portion of the load bearing member 30 to the cab frame 24. Similarly, a conventional hitch arrangement 34 secures an appropriate portion of the load bearing member 30 to the counterweight frame 28. A machine (not illustrated) includes at least one drive sheave that causes movement of the load bearing member 30 and corresponding movement of the cab and counterweight within a hoistway 36 to move the cab 22 between landings in a building, for example.

The illustrated example includes a tension and compensation arrangement 40. An elongated tension member 42 extends between the cab 22 and the counterweight 26. In one example, the tension member 42 comprises at least one steel-core, rubber coated belt. In one example, the belt has a width of 30 mm and is 9.4 mm thick. This example tension member 42 is significantly different than a rope or chain used in conventional compensating arrangements. As can be appreciated from FIG. 2*a* for example, the tension member 42 preferably comprises a plurality of belts. The illustrated example of FIG. 2*a* includes a total of six such belts.

One end of the tension member 42 in this example is secured to a selected portion of the cab frame 24 using a termination 44. In one example, the termination 44 comprises a taluret style ending secured to a selected plank of the cab frame 24. A variety of terminations to secure the tension member to the cab frame 24 may be used. Those skilled in the art who have the benefit of this description will be able to select a termination arrangement that meets their particular needs. The tension member 42 at least partially wraps around sheaves 46 that are part of a base module 48. In the example embodiment of FIG. 1, the other end of the tension member 42 is secured to a damper 50 that is supported for movement with the counterweight through the hoistway 36. The sheaves 46 and the base module 48 remain in the pit 52 such that the sheave axes of rotation do not move relative to the bottom surface of the pit 52.

In one example, the sheaves 46 are made from plastic and are grooved to accommodate the desired number and configuration of the belts used for the tension member 42. In one example, the sheaves 46 are 178 mm wide and each accommodates three tension member belts. In this example, the sheaves have a diameter of 320 mm. An advantage to using such a sheave is that it is relatively lightweight and provides design flexibility in customizing the groove designs on the sheave.

The tension member 42 extending beneath (according to the drawings) the cab 22 and counterweight 26 insures that appropriate tension remains on the load bearing member 30 to provide the desired traction within the elevator system. Further, the arrangement 40 minimizes the possibility for counterweight jump and, in most circumstances, eliminates counterweight jump.

The illustrated example also includes a cab damper 54 and a counterweight damper 56, which are schematically shown and operate in a conventional manner.

Figure 2A:
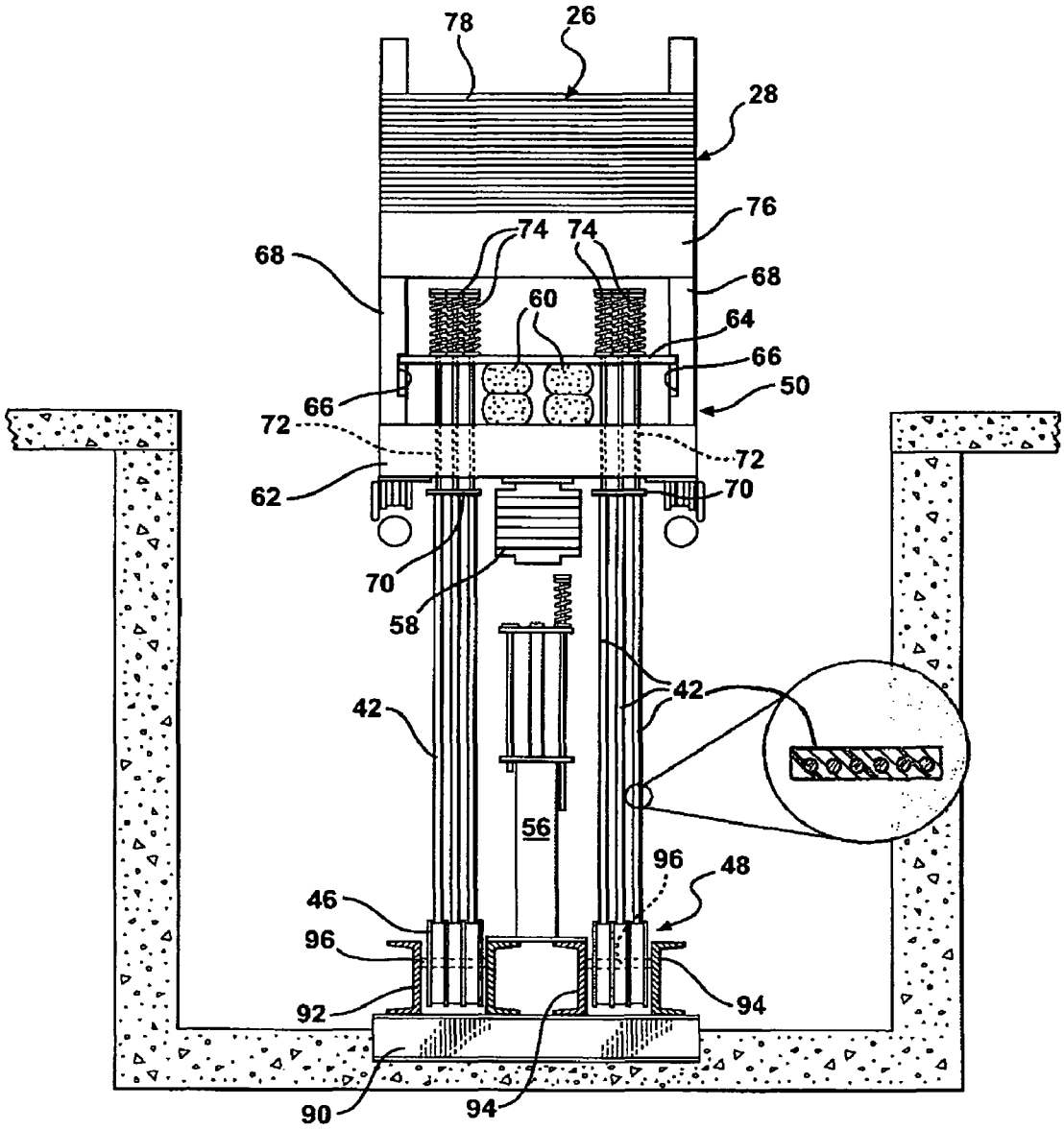
FIG. 2*a* schematically illustrates an embodiment designed according to the embodiment of FIG. 1 and is a view taken along the lines 2-2 in FIG. 1.

Referring now to FIG. 2*a*, the damper 50 of one example embodiment is schematically shown. The counterweight 26 includes a conventional strike block 58 that cooperates with the damper 56 in a known manner. The damper 50 is supported for movement with the counterweight 26 and, in this example, includes air springs 60 that operate to dampen any movement of the counterweight 26 that would correspond to a counterweight jump. The air springs 60 absorb energy that would otherwise cause the counterweight 26 to rise in a counterweight jump movement.

The air springs 60 are supported between a stationary plank 62 and a moveable plank 64. The plank 62 remains fixed relative to the counterweight frame 28. The plank 64 is slidable within grooves 66 formed on vertical members 68 of the counterweight frame 28. In one example, the grooves 66 and the air springs 60 accommodate a maximum stroke or movement of 5.7 inches. In one example, the air springs 60 have a load range between 1,600 and 2,500 pounds with a maximum capacity of 2,750.

The tension member belts 42 include terminations 70 that are secured to thimble rods 72. Springs 74 are associated with opposite ends of the thimble rods 72 and are received against a side of the plank 64 opposite from the air springs 60. The springs 74 bias the ends of the thimble rods away from the plank 64. The ends of the thimble rods 72 and the springs 74 in this example are received in a space between the plank 64 and the stationary plank 76, which provides a support for the fillers 78 provided to achieve the desired mass of the counterweight 26.

During normal elevator operation, the tension member 42 is kept under tension, in part, by the bias of the springs 74. One function of the springs 74 is to accommodate any belt stretch in the tension member 42 during the service life of the elevator system.

Under some circumstances, such as when the cab 22 moves downward relatively quickly then stops, the springs 74 dampen an initial tendency of the counterweight 26 to continue moving upward even though the cab 22 has stopped moving downward. Once the bias of the springs 74 is overcome and the springs 74 are compressed a desired amount, the air springs 60 are compressed allowing the plank 64 to move downward (according to the drawing) toward the plank 62. Depending on a particular elevator system configuration, those skilled in the art who have the benefit of this description will be able to select appropriate springs 74 and appropriate air springs 60 to achieve the desired damping effect to meet the needs of their particular situation. The compression of the springs 74 followed by the compression of the air springs 60 operates to absorb the energy that otherwise would tend to cause counterweight jump. The air springs 60 also absorb the additional load on the tension member 42 under such circumstances.

Figure 2B:
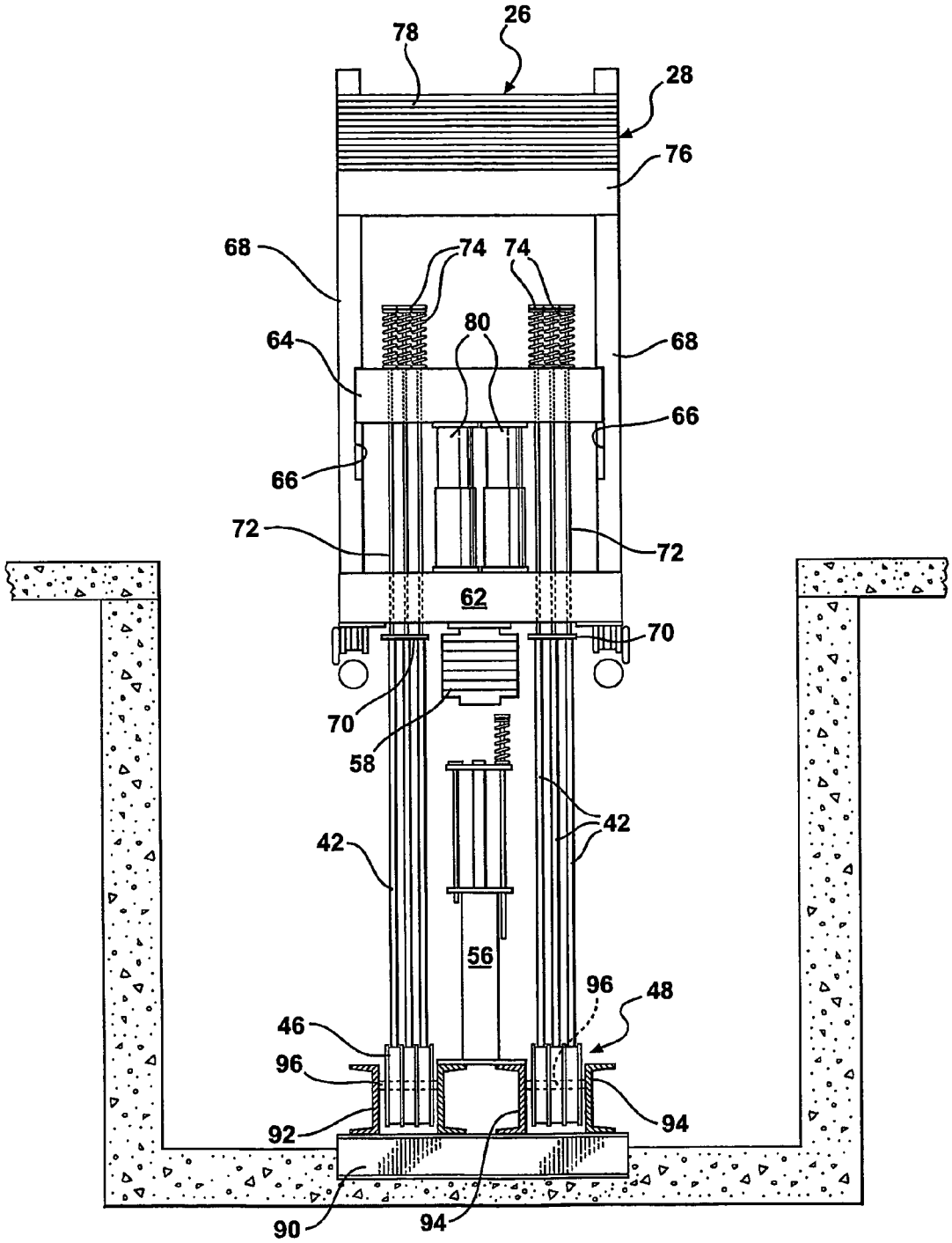
FIG. 2*b* schematically illustrates an alternative embodiment designed according to the embodiment of FIG. 1 and is a view taken along the lines 2-2 in FIG. 1.

FIG. 2*b* shows another example embodiment where pressurized actuators 80 are supported between the moveable plank 64 and the stationary plank 62 in place of the air springs 60 of the embodiment of FIG. 2*a*. The pressurized actuators 80 may be hydraulic or pneumatic devices for example. In one example, the pressurized actuators 80 are load suppressors that are calibrated to drop or be compressed at a designed poundage after the springs 74 have reached a desired maximum compression and capacity. In one example, the actuators 80 are non-returning such that once they are compressed they do not return to the non-compressed state (shown in FIG. 2*b*, for example) without some manual adjustment made by a technician, for example. In another example, the actuators 80 are switch released to return to a non-compressed state. In still another example, the actuators 80 are slow return load cells that automatically, slowly return to a non-compressed state where the plank 64 is at the furthest possible distance from the plank 62.

The actuators 80 operate in the same manner as the air springs 60 in that they compress to absorb the energy that otherwise would cause counterweight jump under appropriate circumstances.

Figure 2C:
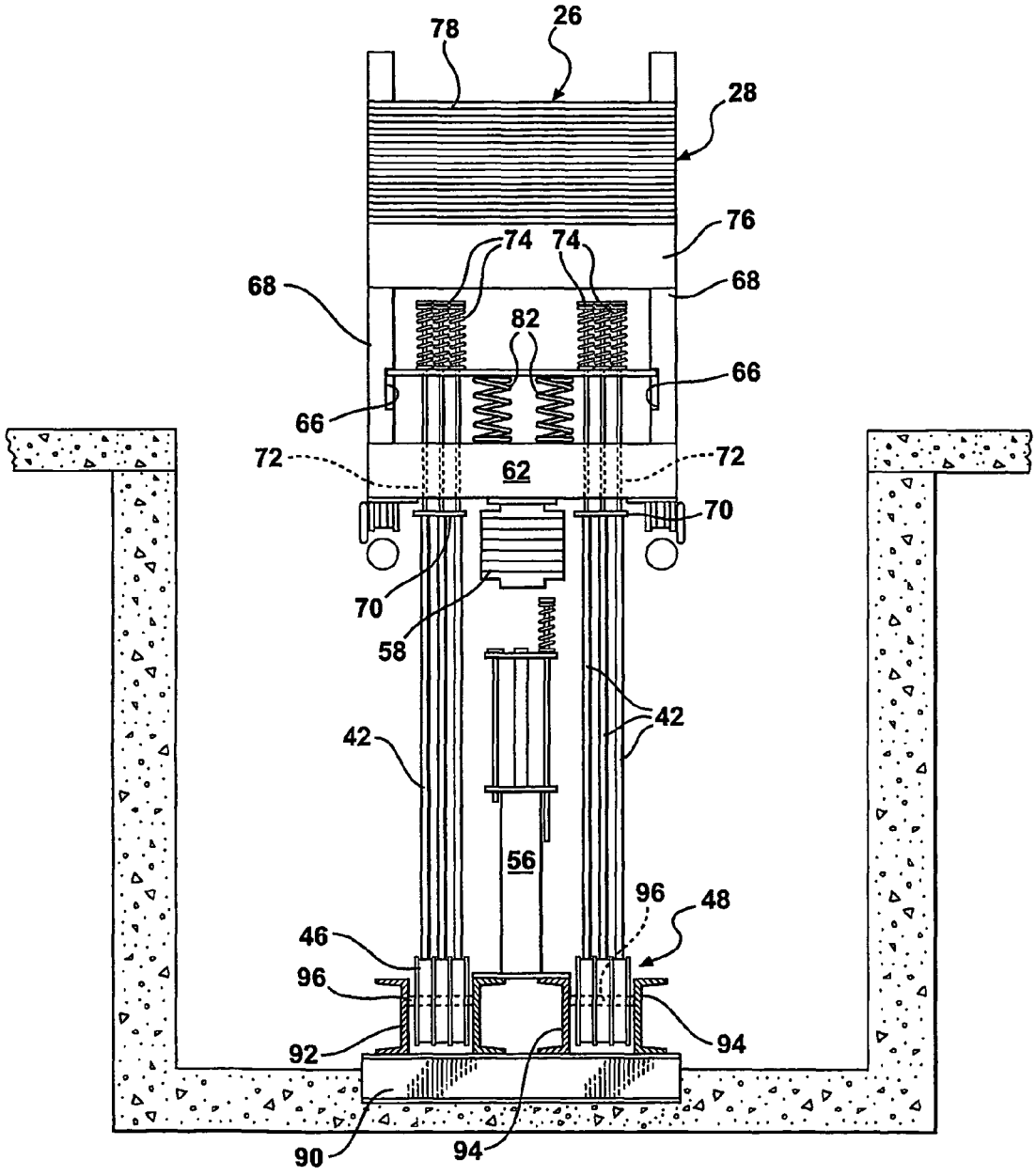
FIG. 2*c* schematically illustrates another alternative embodiment designed according to the embodiment of FIG. 1 and is a view taken along the lines 2-2 in FIG. 1.

FIG. 2*c* shows another example embodiment where the damper 50 includes mechanical springs 82 in place of the air springs 60 or the actuators 80 from the two previous examples. The mechanical springs 82 operate in the same general manner to dampen movement of the counterweight relative to the cab after the cab is stopped following a downward travel.

Figure 3:
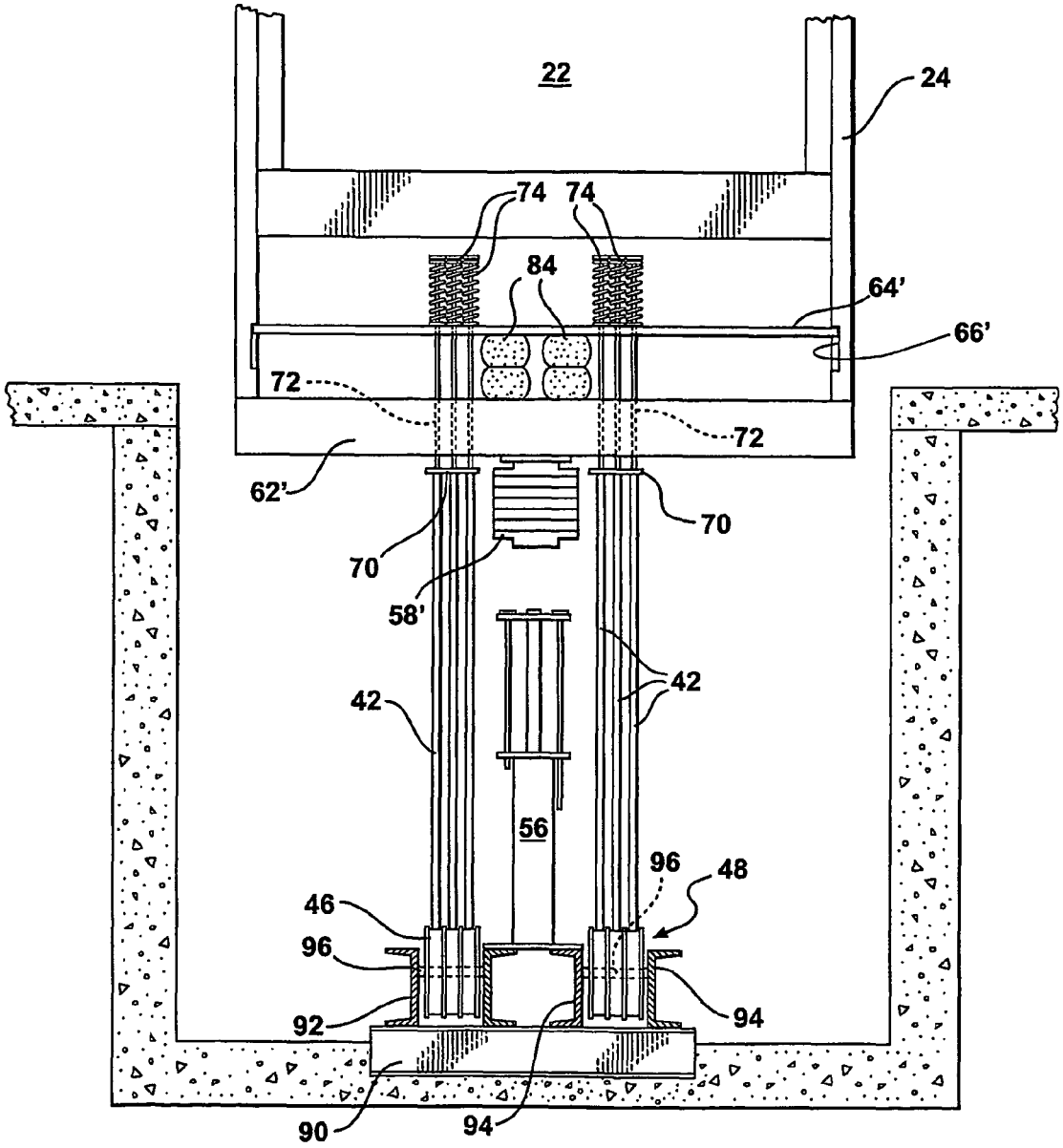
FIG. 3 schematically illustrates an alternative embodiment as that would be seen taken along the lines 3-3 in FIG. 1.

Although the three previous examples each include the damper 50 supported on the counterweight frame 28, this invention also includes a damper 50 associated with the cab 22. FIG. 3 schematically illustrates an example arrangement where the damper 50' is supported for movement with the cab 22 rather than with the counterweight 26. In this example, air springs 84 similar to the air springs 60 of FIG. 2*a* are associated with thimble rods and springs, which are associated with appropriate portions of the cab frame 24. The damper 50' in this example performs the same general function as the damper described in the previous examples. Any movement of the counterweight 26 after the cab 22 has stopped will be suppressed or damped by operation of the damper 50'. Similarly, any potential cab jump is controlled.

Figure 4:
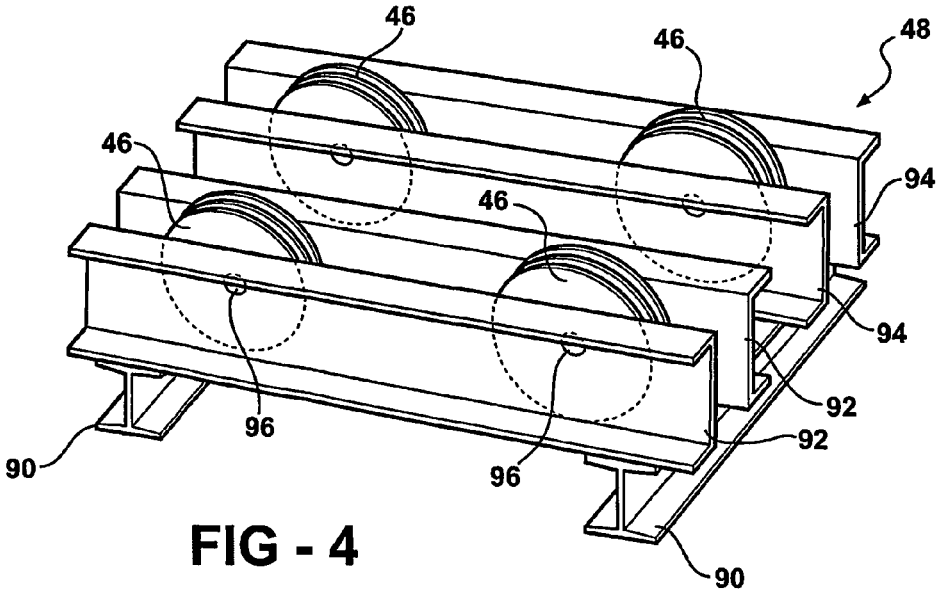
FIG. 4 is a perspective, diagrammatic illustration of an example base module designed according to an embodiment of this invention.

While the example of FIG. 3 shows air springs 84, it is possible to include pressurized actuators or mechanical springs similar to those used in the examples of FIGS. 2*b* and 2*c* as part of a damper supported for movement with the cab The tension member 42 at least partially wraps around the sheaves 46, which are part of the base module 48 that remains stationary within the pit 52. FIG. 4 diagrammatically illustrates an example base module arrangement. In this example, base supports 90 are secured to the floor of the pit 52 in a conventional manner. In one example, the base supports 90 comprise steel I beams. Sheave supports 92 are secured to the base supports 90 using conventional welding techniques or bolts, for example. In this example, the sheave supports 92 and 94 comprise C-shaped steel beams. Axles 96 are supported by the sheave supports and allow the sheaves 46 to rotate freely responsive to movement of the tension member 42, which is responsive to movement of the cab and counterweight within the hoistway as caused by movement of the load bearing member 30.

A significant advantage to a tie-down compensation arrangement designed according to this invention is that it allows for a smaller pit depth yet still provides maximum functionality for maintaining a desired tension on the load bearing member 30 and minimizing the likelihood for counterweight jump. In one example, the inventive arrangement allows for using a pit depth as shallow as 6'10½" compared to conventional arrangements that would require a pit depth of greater than 10'. In one example, a pit depth savings of almost 4' is achieved using the inventive arrangement. This provides the significant advantage of being able to use a tie-down compensation arrangement even for relatively high rise elevator systems where conventional chain compensation does not adequately address the tension and counterweight jump elimination requirements.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

a cab;

a counterweight;

a load bearing member extending between the cab and the counterweight so that the cab and counterweight move simultaneously;

a tension member extending between the cab and the counterweight, the tension member providing a desired tension on the load bearing member;

a termination associated with an end of the tension member, the termination including an elastic element that dampens an initial tendency of the cab or the counterweight to continue moving even though the other of the cab or the counterweight has stopped; and a damper supported for movement with one of the cab or the counterweight, the one end of the tension member being associated with the damper such that the damper reduces motion of the cab or the counterweight when the other of the cab or the counterweight has stopped after a bias of the elastic element is overcome and the elastic element is at least partially compressed.

2. The system of claim 1, including a stationary base supported beneath a lowest available position of the cab and a plurality of sheaves rotatably supported on the base, the tension member moving along the sheaves as the cab and counterweight move.

3. The system of claim 2, wherein the sheaves comprise plastic.

4. The system of claim 3, wherein the tension member has an outside dimension and the sheaves have a diameter that is approximately thirty times greater than the tension member outside dimension.

5. The system of claim 3, wherein the sheaves have a diameter in the range from about 290 mm to about 330 mm.

6. The system of claim 1, wherein the damper comprises at least one of an air spring, a pneumatic damper, a hydraulic damper or a mechanical spring.

7. The system of claim 6, including a first member acting against one side of the damper and a second member associated with an opposite side of the damper, the first member remaining stationary relative to the cab or counterweight with which the damper moves, the second member being moveable relative to the first member, the damper resisting movement of the second member toward the first member.

8. The system of claim 6, wherein the termination is secured near one end of each of a plurality of thimble rods, an opposite end of the thimble rods being positioned on an opposite side of the second member from the damper and, wherein the elastic element comprises a spring associated with each opposite end of each thimble rod to urge the opposite ends away from the second member.

9. The system of claim 1, wherein the tension member comprises a plurality of belts each having a thickness of approximately 10 mm and a width of approximately 30 mm.

10. An elevator system, comprising:

a cab;

a counterweight;

a load bearing member extending between the cab and the counterweight so that the cab and counterweight move simultaneously;

a tension member extending between the cab and the counterweight, the tension member facilitating maintaining a desired tension on the load bearing member;

a stationary base beneath a lowest available position of the cab and a plurality of sheaves rotatably supported on the base, the sheaves having axes that remain stationary, the tension member moving along the sheaves as the cab and counterweight move;

a termination associated with an end of the tension member, the termination including an elastic element that dampens an initial tendency of the cab or the counterweight to continue moving even though the other of the cab or the counterweight has stopped; and a damper supported for movement with one of the cab or the counterweight, the one end of the tension member being associated with the damper such that the damper reduces motion of the cab or the counterweight when the other of the cab or the counterweight has stopped after a bias of the elastic element is overcome and the elastic element is at least partially compressed.

11. The system of claim 10, including a first member acting against one side of the damper and a second member associated with an opposite side of the damper, the first member remaining stationary relative to the cab or counterweight with which the damper moves, the second member being moveable relative to the first member, the damper resisting movement of the second member toward the first member.

12. The system of claim 11, wherein the termination is secured near one end of each of a plurality of thimble rods, an opposite end of the thimble rods being positioned on an opposite side of the second member from the damper and, wherein the elastic element comprises a spring associated with each opposite end of each thimble rod to urge the opposite ends away from the second member.

13. The system of claim 10, wherein the tension member has an outside dimension and the sheaves have a diameter that is approximately thirty times greater than the tension member outside dimension.

14. The system of claim 13, wherein the sheaves have a diameter in the range from about 290 mm to about 330 mm.

15. The system of claim 10, wherein the damper comprises at least one of an air spring, a pneumatic damper, a hydraulic damper or a mechanical spring.

16. The system of claim 10, wherein the tension member comprises a plurality of belts each having a thickness of approximately 10 mm and a width of approximately 30 mm.

17. An assembly for providing tension on a load bearing member in an elevator system, comprising:

an elongate tension member having a first end that is adapted to be secured to one of a cab or a counterweight;

a termination associated with an end of the tension member, the termination including an elastic element that dampens an initial tendency of the cab or the counterweight to continue moving even though the other of the cab or the counterweight has stopped;

a damper that is adapted to be supported for movement with the other of the cab or the counterweight, a second end of the tension member being associated with the damper such that the damper absorbs a load on the tension member under selected conditions after a bias of the elastic element is overcome and the elastic element is at least partially compressed; and a base module that is adapted to be secured in a pit and that includes at least one sheave having an axis of rotation that remains stationary relative to the pit, the tension member at least partially wrapping around the sheave.

18. The assembly of claim 17, wherein the damper includes at least one of an air spring, a hydraulic actuator, a pneumatic actuator or a mechanical spring.

19. An elevator system, comprising:

a cab;

a counterweight;

a load bearing member extending between the cab and the counterweight so that the cab and counterweight move simultaneously;

a tension member extending between the cab and the counterweight, the tension member providing a desired tension on the load bearing member, the tension member comprising a plurality of belts each having a thickness of approximately 10 mm and a width of approximately 30 mm; and a damper supported for movement with one of the cab or the counterweight, one end of the tension member being associated with the damper such that the damper reduces motion of the cab or the counterweight when the other of the cab or the counterweight has stopped.

20. The system of claim 19, including a stationary base supported beneath a lowest available position of the cab and a plurality of sheaves rotatably supported on the base, the tension member moving along the sheaves as the cab and counterweight move.

21. The system of claim 20, wherein the tension member has an outside dimension and the sheaves have a diameter that is approximately thirty times greater than the tension member outside dimension.

22. The system of claim 20, wherein the sheaves have a diameter in the range from about 290 mm to about 330 mm.

* * * * *